US007883431B2

(12) United States Patent
Matsunaga et al.

(10) Patent No.: US 7,883,431 B2
(45) **Date of Patent: *Feb. 8, 2011**

(54) GOLF CLUB HEAD

(75) Inventors: Hideo Matsunaga, Chichibu (JP); Makoto Kubota, Tokyo (JP); Masaomi Hiruta, Tokyo (JP)

(73) Assignee: Bridgestone Sports Co., Ltd, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/871,132

(22) Filed: Oct. 11, 2007

(65) Prior Publication Data

US 2008/0261719 A1 Oct. 23, 2008

(30) Foreign Application Priority Data

Oct. 13, 2006 (JP) ..... 2006-280297

(51) Int. Cl.
*A63B 53/04* (2006.01)

(52) U.S. Cl. ..... 473/329; 473/335; 473/342; 473/345; 473/346; 473/349

(58) Field of Classification Search ..... 473/324–350, 473/287–292

See application file for complete search history.

(56) References Cited

U.S. PATENT DOCUMENTS 1,582,836 A * 4/1926 Link ..... 473/346
4,502,687 A * 3/1985 Kochevar ..... 473/346
5,346,217 A 9/1994 Tsuchiya et al.
5,390,924 A * 2/1995 Antonious ..... 473/328
5,547,188 A 8/1996 Dumontier et al.
5,755,624 A * 5/1998 Helmstetter ..... 473/291
5,755,627 A 5/1998 Yamazaki et al.
5,908,356 A * 6/1999 Nagamoto ..... 473/224
5,941,782 A 8/1999 Cook
6,440,009 B1 8/2002 Guibaud et al.

(Continued)

FOREIGN PATENT DOCUMENTS

EP 1 757 337 A1 2/2007

(Continued)

OTHER PUBLICATIONS

United Kingdom Search Report dated Feb. 26, 2008.

(Continued)

*Primary Examiner*—Sebastiano Passaniti
(74) *Attorney, Agent, or Firm*—Sughrue Mion, PLLC

(57) ABSTRACT

There is provided a golf club head capable of increasing carry on average even if being used by an amateur golfer who is prone to hit a ball with various hit points across the clubface. A golf club head 1 has a face part 2, a crown part 3, a sole part 4, a side part 5, and a hosel part 6, which are formed of titanium or a titanium alloy. The golf club head 1 is formed by integrating a head body 10 and a face plate 30 with each other by welding such as laser welding or plasma welding. A thick part 20 is provided only in the central portion in the toe-heel direction of the cross corner portion between the face part 2 and the sole part 4. The width in the toe-heel direction of the thick part 20 is 20 mm or narrower.

19 Claims, 5 Drawing Sheets

U.S. PATENT DOCUMENTS

| | | | | |
|---|---|---|---|---|
| 6,572,491 | B2 * | 6/2003 | Hasebe et al. | 473/349 |
| 6,595,871 | B2 | 7/2003 | Sano | |
| 6,719,645 | B2 * | 4/2004 | Kouno | 473/345 |
| 6,743,119 | B2 | 6/2004 | Lo | |
| 6,780,123 | B2 | 8/2004 | Hasebe | |
| 6,780,124 | B2 * | 8/2004 | Lu | 473/342 |
| 6,783,465 | B2 | 8/2004 | Matsunaga | |
| 6,949,031 | B2 * | 9/2005 | Imamoto et al. | 473/329 |
| 7,232,381 | B2 | 6/2007 | Imamoto et al. | |
| 7,241,230 | B2 * | 7/2007 | Tsunoda | 473/324 |
| 2001/0007837 | A1 | 7/2001 | Hasebe et al. | |
| 2002/0049097 | A1 | 4/2002 | Murphy et al. | |
| 2002/0082117 | A1 | 6/2002 | Nishitani et al. | |
| 2003/0083145 | A1 * | 5/2003 | Tsurumaki | 473/305 |
| 2004/0018889 | A1 | 1/2004 | Yamamoto | |
| 2004/0038750 | A1 * | 2/2004 | Lo | 473/346 |
| 2004/0224785 | A1 | 11/2004 | Hasebe | |
| 2005/0124436 | A1 * | 6/2005 | Kakiuchi et al. | 473/345 |
| 2005/0245329 | A1 | 11/2005 | Nishitani et al. | |
| 2005/0250594 | A1 | 11/2005 | Nishitani et al. | |
| 2006/0111198 | A1 | 5/2006 | Matsunaga | |
| 2006/0293119 | A1 * | 12/2006 | Hou | 473/342 |
| 2007/0275792 | A1 * | 11/2007 | Horacek et al. | 473/346 |
| 2008/0139338 | A1 | 6/2008 | Matsunaga et al. | |
| 2008/0220894 | A1 * | 9/2008 | Matsunaga et al. | 473/346 |

FOREIGN PATENT DOCUMENTS

| | | | |
|---|---|---|---|
| JP | 61-249485 | A | 11/1986 |
| JP | 5-29563 | U | 4/1993 |
| JP | 06-343722 | A | 12/1994 |
| JP | 08-126723 | A | 5/1996 |
| JP | 09-154985 | A | 6/1997 |
| JP | 11-216203 | A | 8/1999 |
| JP | 2000-317018 | A | 11/2000 |
| JP | 2001-046559 | A | 2/2001 |
| JP | 2001-070486 | A | 3/2001 |
| JP | 2001-137396 | A | 5/2001 |
| JP | 2001-187174 | A | 7/2001 |
| JP | 2001-353240 | A | 12/2001 |
| JP | 2002-119625 | A | 4/2002 |
| JP | 2003-052866 | A | 2/2003 |
| JP | 2003-265652 | A | 9/2003 |
| JP | 2003-265653 | A | 9/2003 |
| JP | 2004-041376 | A | 2/2004 |
| JP | 2004-187795 | A | 7/2004 |
| JP | 2004-222792 | A | 8/2004 |
| JP | 2005-021649 | A | 1/2005 |

OTHER PUBLICATIONS

Chinese Office Action in counterpart Chinese Patent Application No. 200710106005.2 dated Sep. 26, 2010, Partial English Translation.

* cited by examiner

GOLF CLUB HEAD

BACKGROUND OF THE INVENTION AND RELATED ART STATEMENT

1. Field of the Invention

The present invention relates to a metallic hollow golf club head and, more particularly, to a large golf club head such as a driver.

2. Description of Related Art

As a wood-type golf club head such as a driver and a fairway wood, metallic hollow golf club heads have been widely used. Generally, hollow wood-type golf club heads have a face part for hitting a ball, a crown part constituting the top surface portion of the golf club head, a sole part constituting the bottom surface portion of the golf club head, a side part constituting the side surface portions on the toe side, back side, and heel side of the golf club head, and a hosel part. In this hosel part, a shaft is inserted and fixed by an adhesive or the like.

As a metal forming the hollow golf club head, an aluminum alloy, stainless steel, or titanium alloy has been used, and especially titanium alloy has been used widely in recent years.

Japanese Patent Provisional Publication No. 11-216203 discloses a golf club head in which the thickness on the front edge side along the face part of the sole part is increased. In FIG. 2 of this publication, this thick part is provided throughout the whole of the front edge of the sole part, and in FIG. 4 of this publication, the thick part is provided on the toe side and the heel side.

Conventionally, to increase the shot carry of a metallic hollow golf club head, development for increasing the rebound of the ball by utilizing the deflection (trampolining effect) of the face surface has been carried out. However, since the golf rules governing the upper limit of the rebound coefficient have been revised, carry now has to be increased by other measures. In the case of what is called a high-rebound type golf club head utilizing the trampolining effect, although a long carry can be attained when a ball is hit by the face center, such a long carry cannot be obtained when the hit point deviates from the face center (off-center hit).

According to the golf club head described in the aforementioned Japanese Patent Provisional Publication No. 11-216203, the center of gravity of the head can be lowered while the balance of inertia moment is maintained. However, in FIG. 2 of the publication, since the thick part exists throughout the whole from the toe to the heel of the front edge of the sole part, the deflection of the face part at the ball hit time is restrained as a whole, so that the carry decreases.

Also, in FIG. 4 of the publication, since the thick part is provided separately on the sole side and the heel side, the deflection of the face part at the time of off-center hit is restrained, so that the carry decreases. In addition, since the deflection of the face part at the time when a ball is hit by the face center is great, the rebound coefficient easily exceeds the limit placed by the golf rules.

OBJECT AND SUMMARY OF THE INVENTION

An object of the present invention is to provide a golf club head capable of increasing carry on average even if being used by an amateur golfer who is prone to hit a ball with various hit points across the clubface.

A golf club head in accordance with the present invention is characterized in that in a metallic hollow golf club head having at least a face part, a sole part, a side part, and crown part, a thick part is provided in the central portion in the toe-heel direction of the cross corner portion between the face part and the sole part in the golf club head.

In the golf club head in accordance with the present invention, which is configured as described above, since the thick part is provided only in the central portion in the toe-heel direction of the cross corner portion between the sole part and the face part, the deflection near the center of the face part is restrained, and the rebound coefficient can be kept within the range of the golf rules. On the other hand, on the toe side and the heel side of the face part, the thick part is not provided, and therefore the deflection at the ball hit time increases. Therefore, the carry of off-center hit increases. However, on the toe side and the heel side of the face part, the rebound coefficient is low as compared with the face center. Therefore, even if the deflection increases, the rebound coefficient does not deviate from the golf rules. According to the present invention, the difference in carry between face center hit and off-center hit decreases, and therefore a stable fly can be obtained.

For these reasons, even if the golf club head is used by an amateur golfer who often hits a ball by a hit point other than the center of face surface and does not attain so high a head speed, the carry increases on average. Also, the golf club head does not deviate from the golf rules.

The present invention is suitable for being applied to a large head having a volume of 250 to 460 cc.

DETAILED DESCRIPTION OF PREFERRED EMBODIMENTS

Embodiments of the present invention will now be described with reference to the accompanying drawings.

Figure 1A:
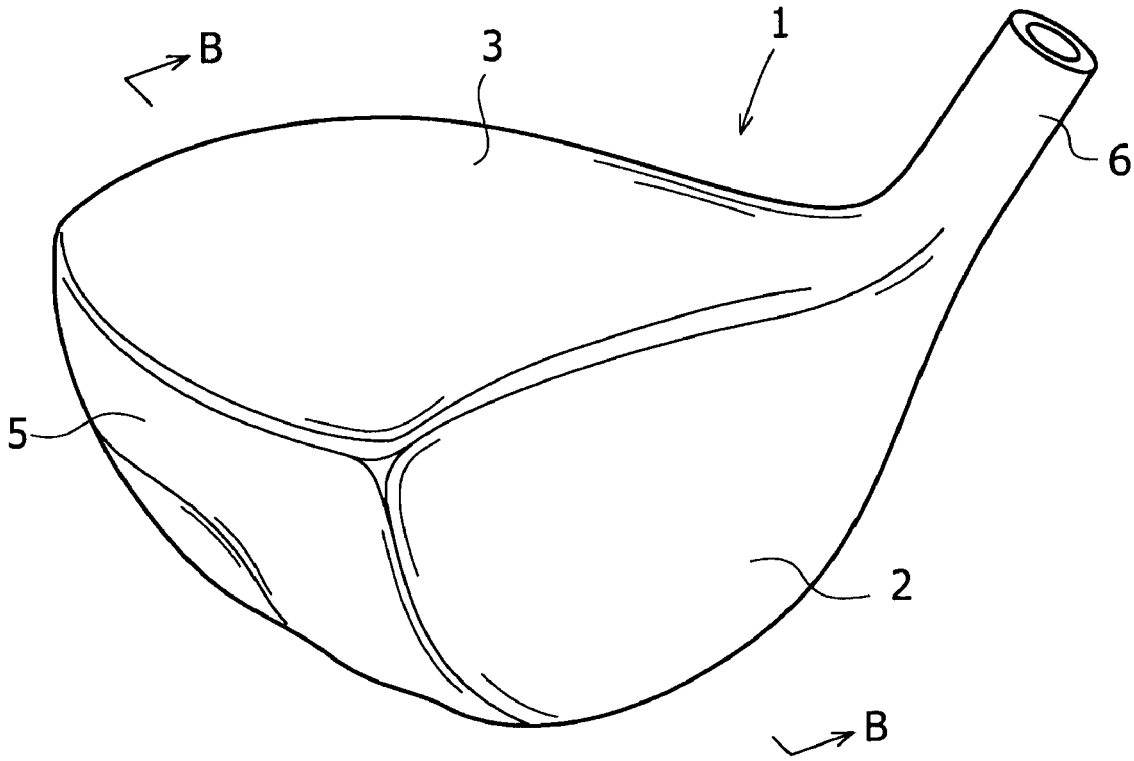
FIG. 1A is a perspective view of a golf club head in accordance with an embodiment of the present invention.
Figure 1B:
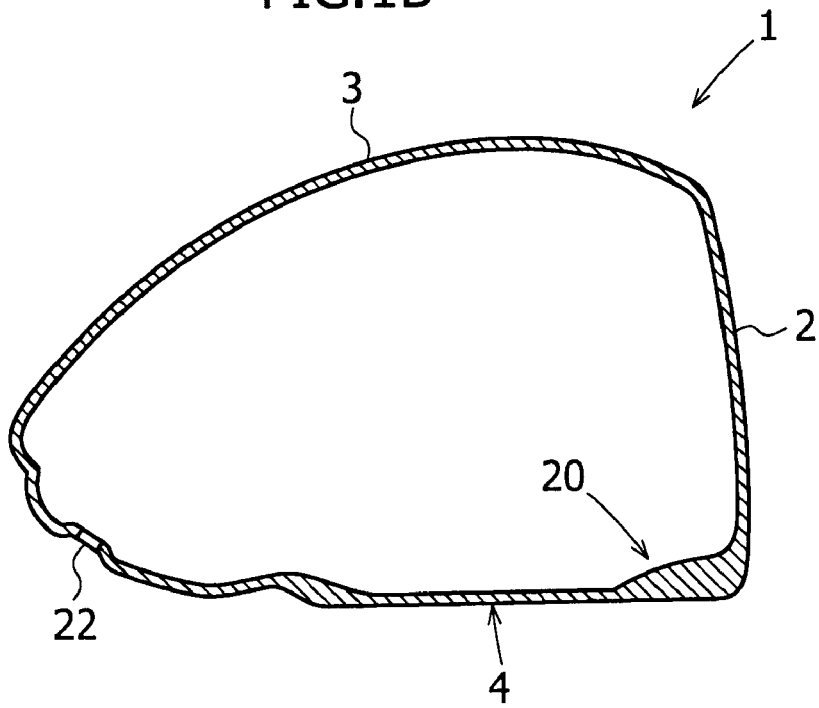
FIG. 1B is a sectional view taken along the line B-B of FIG. 1A.
Figure 2:
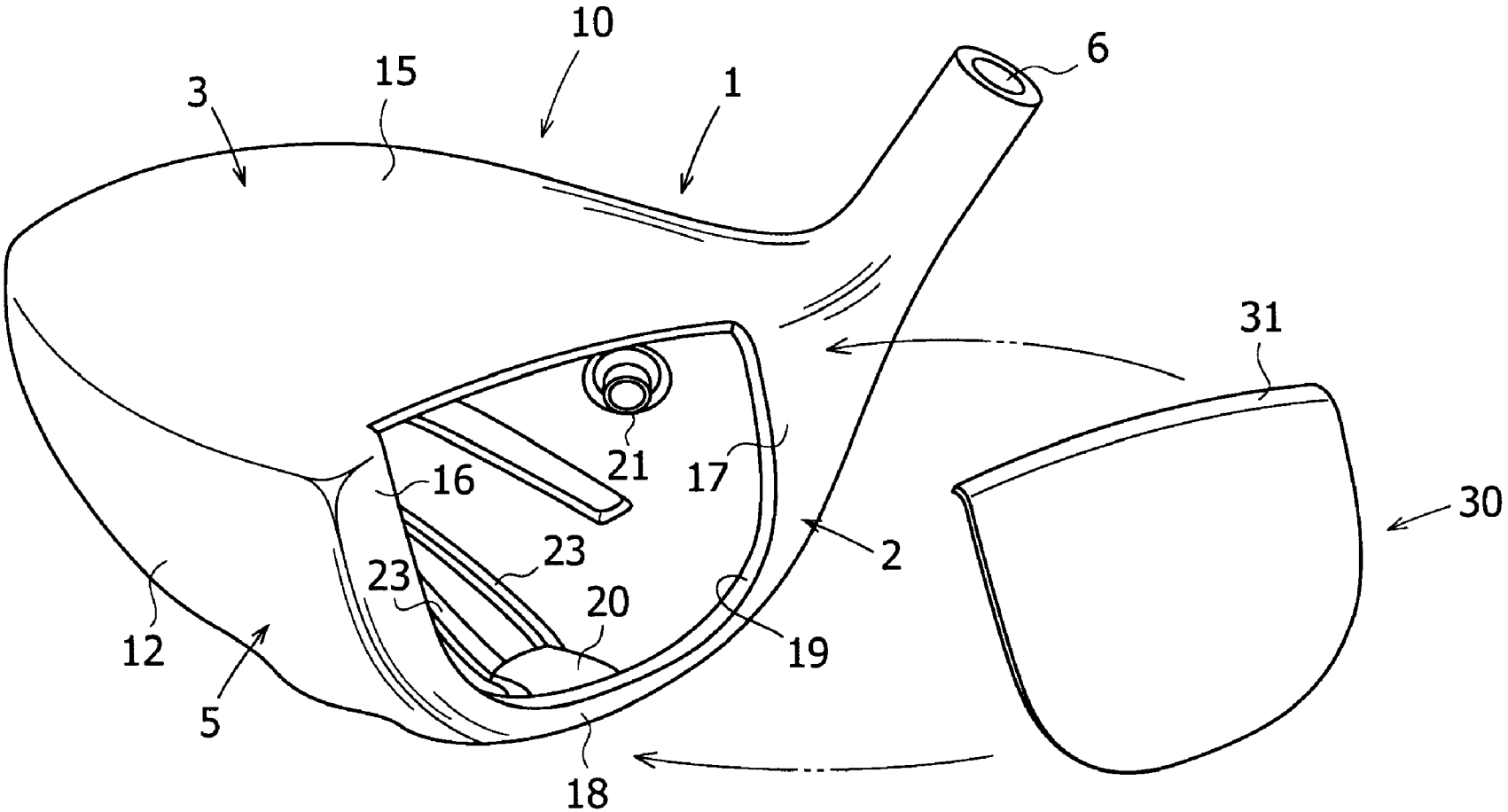
FIG. 2 is an exploded perspective view of a golf club head in accordance with an embodiment of the present invention.
Figure 3:
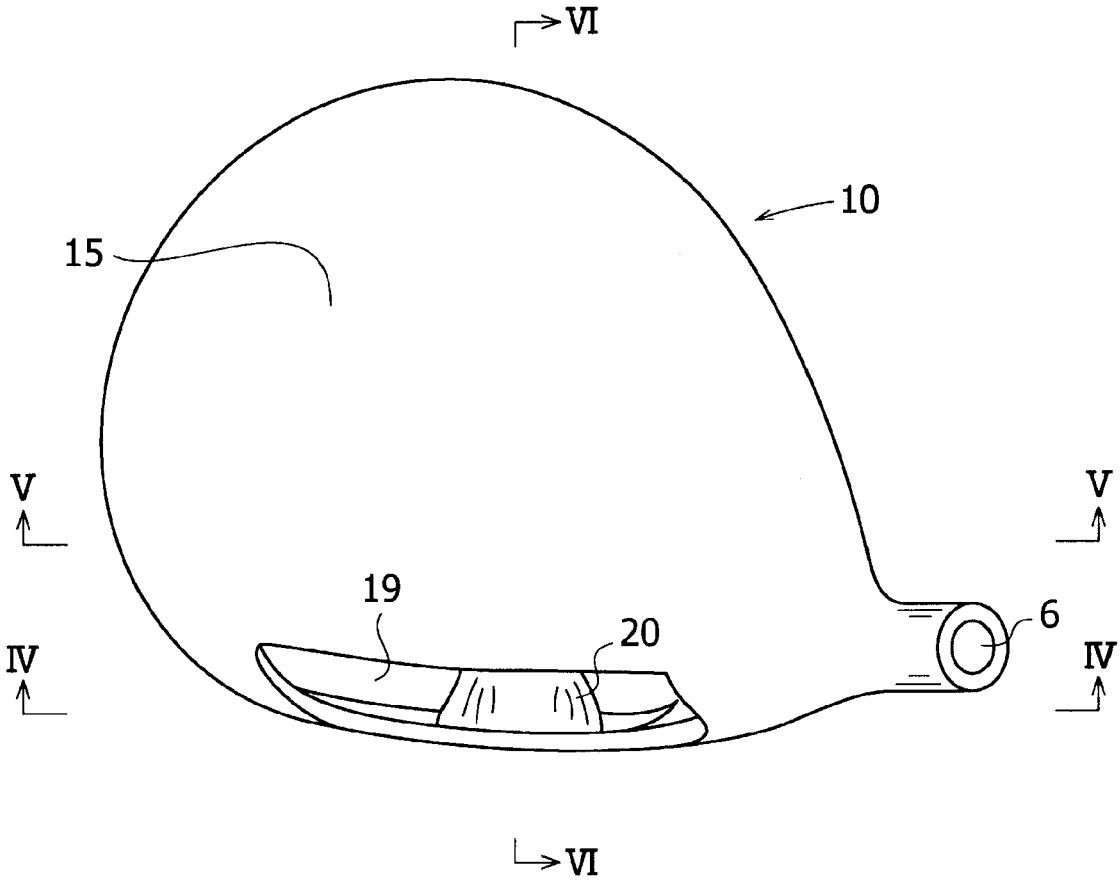
FIG. 3 is a plan view of a head body of a golf club head in accordance with an embodiment of the present invention.
Figure 4:
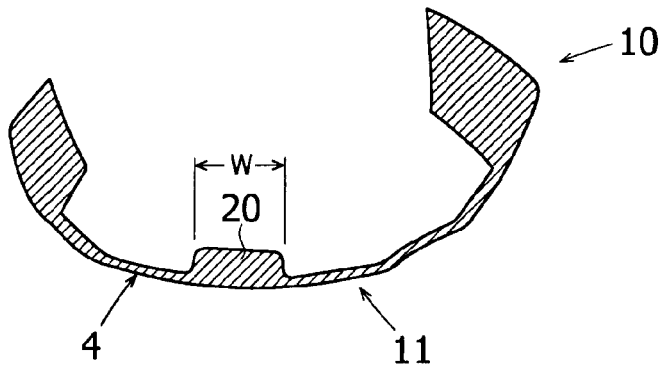
FIG. 4 is a sectional view taken along the line IV-IV of FIG. 3.
Figure 5:
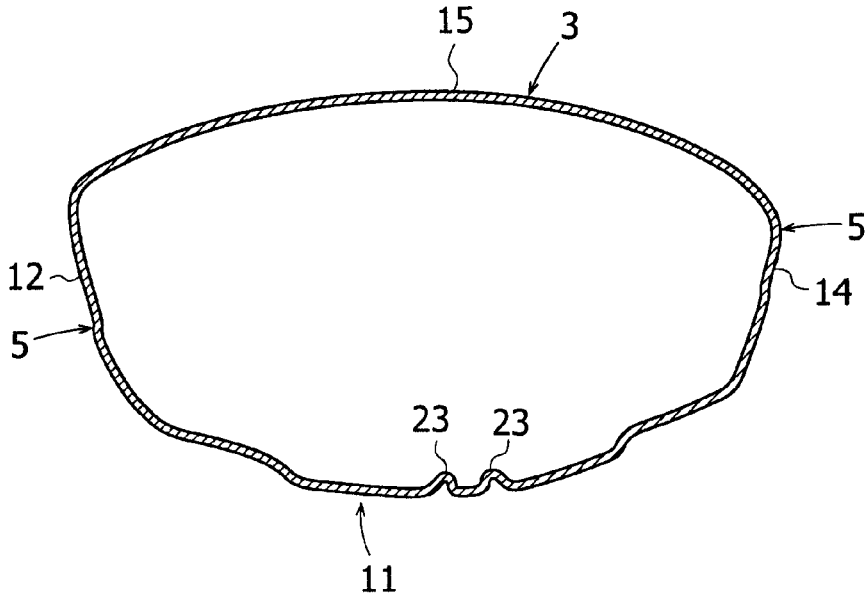
FIG. 5 is a sectional view taken along the line V-V of FIG. 3.
Figure 6:
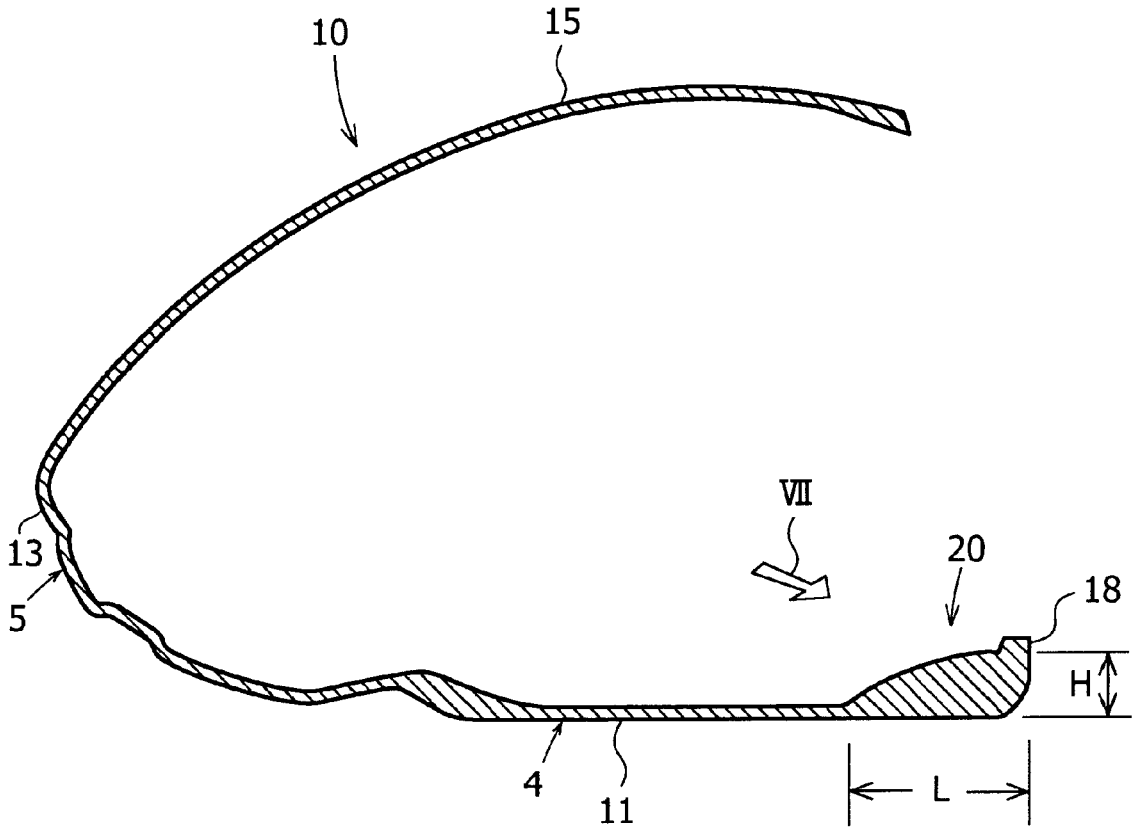
FIG. 6 is a sectional view taken along the line VI-VI of FIG. 3.
Figure 7:
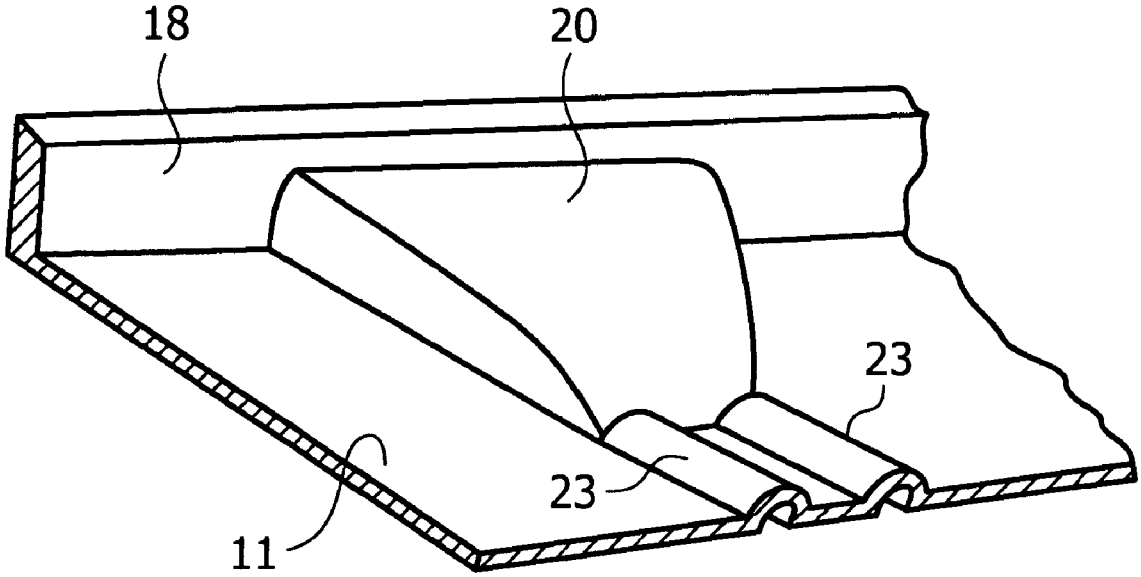
FIG. 7 is a perspective view taken in the direction of the arrow VII of FIG. 6, showing a thick part.

FIGS. 1A and 1B are a perspective view and a sectional view, respectively, of a golf club head in accordance with an embodiment. FIG. 2 is an exploded perspective view of the golf club head shown in FIGS. 1A and 1B. FIG. 3 is a plan view of a head body. FIGS. 4, 5 and 6 are sectional views taken along the lines IV-IV, V-V and VI-VI, respectively, of FIG. 3, and FIG. 7 is a perspective view taken in the direction of the arrow VII of FIG. 6.

A golf club head 1 has a face part 2, a crown part 3, a sole part 4, a side part 5, and a hosel part 6. As shown in FIG. 2, the golf club head 1 is formed by integrating a head body 10 and a face plate 30 with each other by welding such as laser welding or plasma welding. Plasma welding and laser welding have a high energy density, and therefore can provide a weld having a deep penetration and good appearance with high accuracy as compared with TIG (Tungsten Inert Gas) welding.

As clearly shown in FIGS. 2 to 6, the head body 10 has a bottom surface 11 forming the sole part 4, a toe elevation surface 12, a back elevation surface 13, and a heel elevation surface 14 forming the side part 5, a top surface 15 connecting with the upper edges of these elevation surfaces 12 to 14, and a toe flange 16, a heel flange 17, and a lead flange 18 each projecting to the face side from the toe elevation surface 12, the heel elevation surface 14, and the bottom surface 11, respectively. An opening 19 is provided ranging from the front edge of the crown part 3 to most of the face part 2. On this head body 10, the hosel part 6 is provided integrally.

Reference numerals 21 and 22 shown in FIGS. 2 and 1B denote mounting parts for a weight (not shown) formed of a metal having a high specific gravity, such as tungsten. As shown in FIGS. 2 and 5, on the bottom surface 11, curved ridge parts 23 extending in the front and rear direction are provided.

The face plate 30 constitutes a region excluding the flanges 16, 17 and 18 of the face part 2 (a face main portion). The upper edge of the face plate 30 is a projecting part 31 projecting to the crown part 3 side.

By integrating the head body 10 and the face plate 30 with each other by welding, the golf club head 1 is formed. The hosel part 6 may be provided so as to reach the sole part 4 or may be provided so as not to reach the sole part 4. After welding, various finishing treatments such as grinding and painting are performed as necessary to obtain a product golf club head.

The head body 10 is a casting, so that it can be manufactured easily even if having an intricate shape.

The face plate 30 can be formed by any of casting, forging, and pressing. The face plate 30 is provided with grooves (score lines) as necessary.

In this embodiment, both of the head body 10 and the face plate 30 are formed of titanium or a titanium alloy.

As the head body 10, Ti-6Al-4V or Ti-6Al-6V-2Sn, which is an α-β type titanium alloy having a modulus of longitudinal elasticity of 11,000 kgf/mm$^2$ ($107.8\times10^9$ Pa) or higher is typically used. However, Ti-3Al-8V-6Cr-4Mo-4Zr or Ti-22V-4Al, which is a β type titanium alloy that is heat-treated so that the modulus of longitudinal elasticity is in this range, can also be used.

As the face plate 30, either of the aforementioned β type titanium alloy and α-β type titanium alloy may be used.

Next, the preferred dimensions of each part of the golf club head are explained.

The golf club head that is especially effective in applying the present invention is a large golf club head having an easily deflectable crown part, specifically, a golf club head (driver) having a head volume of 250 cc or larger, preferably 300 cc or larger, and further preferably 350 cc or larger.

The upper limit of volume is 460 cc as specified in the golf rules.

The width W in the toe-heel direction of a thick part 20 is preferably 0.5 to 20 mm, especially 5 to 20 mm. The maximum length L (FIG. 6) of the thick part 20 from the lower edge portion of the face surface to the rear is preferably 3 to 35 mm, especially 10 to 30 mm. The maximum height H (FIG. 6) of the thick part 20 from the bottom surface of the sole part is preferably 2 to 20 mm, especially 5 to 10 mm.

As shown in FIGS. 6 and 7, the thick part 20 is preferably configured so that the front portion thereof is highest, and the height thereof decreases toward the rear.

In an exemplary embodiment, the curved ridge parts 23 extend in a rear direction of the sole part 4 from a rear surface of the thick part 20, without extending beyond the rear surface of the thick part 20 in the front direction of the sole part 4. The curved ridge parts 23 comprise a plurality of ribs having a width smaller than that of the thick part 20 and a height lower than that of the thick part 20.

The thickness of the sole part 4 is preferably 0.5 to 2.0 mm, especially 0.7 to 2.0 mm, on average, and the thickness of the face part 2 is preferably 2 to 3.5 mm, especially 2.7 to 3.2 mm, on average. The face part 2 is preferably configured so that the thickness thereof increases gradually from the peripheral edge portion to the central portion thereof.

The thickness of the crown part 3 is preferably 0.5 to 1.2 mm, especially 0.7 to 1.0 mm, on average.

For the golf club head 1 configured as described above, since the thick part 20 is provided only in the central portion in the toe-heel direction of the cross corner portion between the sole part 4 and the face part 2, the deflection near the center of the face part 2 is restrained, and the rebound coefficient can be kept within the range of the golf rules. On the other hand, on the toe side and the heel side of the face part 2, the thick part 20 is not provided, so that the deflection at the ball hit time increases, and therefore the carry of off-center hit increases. However, on the toe side and the heel side of the face part 2, the rebound coefficient is low as compared with the face center. Therefore, even if the deflection increases, the rebound coefficient does not deviate from the golf rules.

For these reasons, even if an amateur golfer who often hits a ball with a hit point other than the center of the face surface, the carry increases on average.

Also, in this embodiment, the range from the face part 2 to the crown part 3 is thin, so that the rebounding force is sufficiently high within the range of limit placed by the golf rules, and therefore the carry increases. Also, the deflection of the crown part 3 at the time when a ball is hit increases the carry.

If the width W in the toe-heel direction of the thick part 20 exceeds 20 mm, the rebounding force at the time when a ball is hit by a hit point other than the face center decreases. Also, if the width W is narrower than 0.5 mm, the thick part 20 is difficult to form.

If the maximum height H of the thick part 20 is increased excessively, the rebounding force of the face part 2 decreases. If the height H is excessively small, the rebound coefficient of face center increases excessively.

Figure 8:
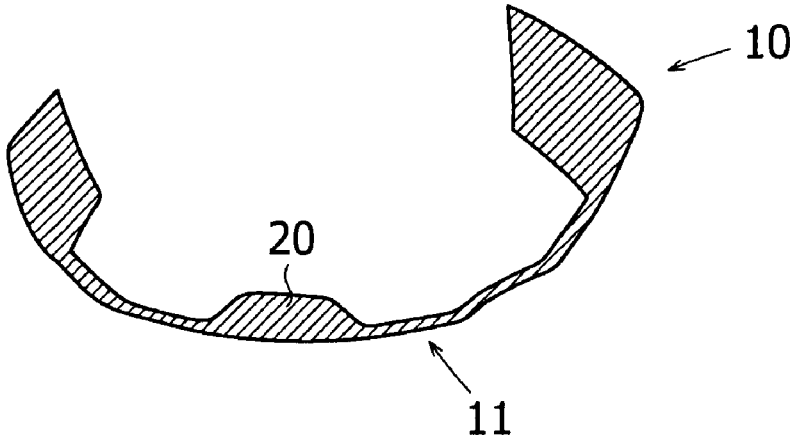
FIG. 8 is a sectional view showing another embodiment.

In the above-described embodiment, the cross section in the toe-heel direction of the thick part 20 is substantially rectangular. However, the thick part 20 may have a trapezoidal cross-sectional shape such that the width increases toward the downside as shown in FIG. 8, or may have a triangular cross-sectional shape, though not shown.

In the above-described embodiment, most of the crown part 3 is formed by the head body 10. However, the projecting part 31 of the face plate 30 may be made longer than shown in the figure so that a wide range of crown part may be formed by the projecting part 31.

EXAMPLES

Example 1

A golf club head having a volume of 460 cc, which is configured as shown in the figures, was manufactured. The head body 10 was formed of (Ti-6Al-4V) α-β type titanium alloy manufactured by the investment casting process. The face plate 30 was manufactured by forging a β type titanium alloy.

The thicknesses of the flange parts 16, 17 and 18 of the head body 10 were made 2.5 mm. The thickness of the crown part was made 0.6 mm, that of the side part 0.7 mm, and that of the sole part (excluding the thick part) 0.9 mm. The thickness of the face plate 30 was made 2.5 mm in the peripheral edge portion thereof, and was increased gradually toward the central portion thereof so that the thickness of the central portion was 3.5 mm. The dimensions of the thick part 20 were as follows: W=20 mm, H=10 mm, and L=15 mm.

The initial velocity, delivery angle, amount of backspin, and carry of ball were measured at the time when a ball was hit by the face center and when a ball was hit with the hit position being shifted 15 mm to the toe side at a head speed of 45 m/s using a swing robot manufactured by Miyamae Co., Ltd.

The measurement results are given in Table 1.

Example 2

Measurement was made in the same way as Example 1 except that the width W in the toe-heel direction of the thick part 20 was made 0.5 mm and the height H was made 10 mm. The measurement results are given in Table 1.

Example 3

Measurement was made in the same way as Example 1 except that the width W in the toe-heel direction of the thick part 20 was made 20 mm and the height H was made 5 mm. The measurement results are given in Table 1.

Example 4

Measurement was made in the same way as Example 1 except that the width W in the toe-heel direction of the thick part 20 was made 20 mm and the height H was made 20 mm. The measurement results are given in Table 1.

Comparative Example 1

Measurement was made in the same way as Example 1 except that the width W in the toe-heel direction of the thick part 20 was made 40 mm and the height H was made 10 mm. The measurement results are given in Table 1.

Comparative Example 2

Measurement was made in the same way as Example 1 except that the width W in the toe-heel direction of the thick part 20 was made 20 mm and the height H was made 30 mm. The measurement results are given in Table 1.

Comparative Example 3

Measurement was made in the same way as Example 1 except that the thick part 20 was not provided, that is, W=0. The measurement results are given in Table 1.

TABLE 1

| | | | | Initial velocity (m/sec) | Delivery angle (launch angle) (degree) | Backspin (rpm) | Carry (m) |
|---|---|---|---|---|---|---|---|
| Example 1 | W = 20 mm | H = 10 mm | Center | 61.7 | 9.8 | 2430 | 208.1 |
| | | | Toe 15 mm | 61.3 | 9.5 | 2640 | 205.4 |
| Example 2 | W = 0.5 mm | H = 10 mm | Center | 61.9 | 9.8 | 2400 | 209.0 |
| | | | Toe 15 mm | 61.4 | 9.5 | 2610 | 205.8 |
| Example 3 | W = 20 mm | H = 5 mm | Center | 62.2 | 9.7 | 2410 | 210.1 |
| | | | Toe 15 mm | 61.6 | 9.4 | 2610 | 206.4 |
| Example 4 | W = 20 mm | H = 20 mm | Center | 61.2 | 9.9 | 2390 | 206.1 |
| | | | Toe 15 mm | 60.8 | 9.6 | 2570 | 203.3 |
| Comparative example 3 | W = 0 mm | H = 0 mm | Center | 62.7 | 9.5 | 2310 | 211.5 |
| | | | Toe 15 mm | 61.7 | 9.1 | 2580 | 205.8 |
| Comparative example 1 | W = 40 mm | H = 10 mm | Center | 61.6 | 9.8 | 2440 | 207.6 |
| | | | Toe 15 mm | 60.7 | 9.5 | 2690 | 202.5 |
| Comparative example 2 | W = 20 mm | H = 30 mm | Center | 60.8 | 10.0 | 2420 | 204.6 |
| | | | Toe 15 mm | 60.4 | 9.7 | 2680 | 201.8 |

From Table 1, according to the present invention, it is recognized that even when a ball is hit by off-center, the carry is long. In Examples 1 to 4, the difference between the initial velocity of ball at the center and that at a hit point shifting 15 mm to the toe side (toe 15 mm) is 0.6 m/s or smaller, while for the general structures of comparative examples 3 and 1, the difference in ball initial velocity is 0.9 m/s or larger, which results in a difference in carry of 5 m or larger. The structure of the golf club head of the present invention in comparative example 2 is unfavorable because if the height of the thick part is made too large, the rebounding force at the center decreases excessively. However, even at the time of off-center hit (toe 15 mm), the difference in ball initial velocity from the face center is 0.4 m/s, which is 1 m/s or smaller, and the difference in carry is on the order of 3 m.

The invention claimed is:

1. A golf club head which is metallic and hollow and has at least a face part, a sole part, a side part, and a crown part in a head body, wherein an opening portion is formed in the face part of the head body, a thick part is provided in the head body, a face plate is fixed to a face opening portion by welding, and the thick part having a predetermined width is provided in a central portion in the toe-heel direction of the cross corner portion between the face part and the sole part in the golf club head, the height of the thick part decreasing toward the rear, and deflection near a center of the face part is restrained so that deflection at a toe side and a heel side increases, and a rebound coefficient at the toe side and the heel side is set low as compared with the face center, wherein the thick part is disposed below an upper plane of a lead flange which projects to a face side from a bottom surface of the golf club head.

2. The golf club head according to claim 1, wherein the average thickness of the face part is 2.5 to 3.5 mm, the length in the toe-heel direction of the thick part is 0.5 to 20 mm, the maximum height from the sole part bottom surface of the thick part is 2.0 to 20 mm, and the maximum length from the face surface to the rear of the thick part is 3 to 35 mm.

3. The golf club head according to claim 2, wherein the metal forming the golf club head is titanium or a titanium alloy.

4. The golf club head according to claim 2, wherein the volume of the golf club head is 250 to 460 cc.

5. The golf club head according to claim 3, wherein the volume of the golf club head is 250 to 460 cc.

6. The golf club head according to claim 1, wherein the metal forming the golf club head is titanium or a titanium alloy.

7. The golf club head according to claim 6, wherein the volume of the golf club head is 250 to 460 cc.

8. The golf club head according to claim 1, wherein the volume of the golf club head is 250 to 460 cc.

9. The golf club head according to claim 1, wherein the head body is an α-β type titanium alloy and the face plate is a β type titanium alloy.

10. The golf club head according to claim 9, wherein the volume of the golf club head is 250 to 460 cc.

11. The golf club head according to claim 1, wherein a rear surface of the lead flange and a joint portion of the thick part of the head body are joined together at their curved surfaces.

12. The golf club head according to claim 11, wherein the average thickness of the face part is 2.5 to 3.5 mm, the length in the toe-heel direction of the thick part is 0.5 to 20 mm, the maximum height from the sole part bottom surface of the thick part is 2.0 to 20 mm, and the maximum length from the face surface to the rear of the thick part is 3 to 35 mm.

13. The golf club head according to claim 11, wherein the thick part having a predetermined width is provided so that the height of the thick part decreases towards the rear.

14. The golf club head according to claim 11, wherein a rear surface of the lead flange and a joint portion of the thick part of the head body are joined together at their curved surfaces.

15. A golf club head which is metallic and hollow and has at least a face part, a sole part, a side part, and a crown part in a head body, wherein a thick part having a predetermined width is provided in a central portion in the toe-heel direction of the cross corner portion between the face part and the sole part in the golf club head, and curved ridge parts extend in a rear direction of the sole part from a rear surface of the thick part, without extending beyond the rear surface of the thick part in the front direction of the sole part, wherein the curved ridge parts comprise a plurality of ribs having a width smaller than that of the thick part and a height lower than that of the thick part.

16. The golf club head according to claim 15, wherein the average thickness of the face part is 2.5 to 3.5 mm, the length in the toe-heel direction of the thick part is 0.5 to 20 mm, the maximum height from the sole part bottom surface of the thick part is 2.0 to 20 mm, and the maximum length from the face surface to the rear of the thick part is 3 to 35 mm.

17. The golf club head according to claim 15, wherein the thick part having a predetermined width is provided so that the height of the thick part decreases towards the rear.

18. The golf club head according to claim 15, wherein a rear surface of a lead flange and a joint portion of the thick part of the head body are joined together at their curved surfaces.

19. A golf club head which is metallic and hollow and has at least a face part, a sole part, a side part, and a crown part in a head body, wherein a face opening portion is formed in the face part of the head body, a thick part is provided in a central portion in the toe-heel direction of the cross corner portion between the face part and the sole part in the head body, and the head body further comprises a toe flange, a heel flange, and a lead flange, which project to the face side respectively from the toe elevation surface, the heel elevation surface, and the bottom surface, a face member for blocking the face opening portion is welded to the head body, the face member constitutes a region excluding the toe flange, the heel flange, and the lead flange of the face part, and the upper edge of the face member comprises a projecting part projecting to the crown part side, the head body is formed of α-β type titanium alloy, and the face member is formed of titanium, a thickness of the toe flange, the heel flange, and the lead flange is substantially greater than a thickness of the sole part and the crown part, and a thickness of the face member is substantially equal to the thickness of the toe flange, the heel flange, and the lead flange at a peripheral edge portion of the face member, and the thickness of the face member increases in a central portion of the face member.

* * * * *